US006027141A

United States Patent [19]

Baumann, Jr.

[11] Patent Number: 6,027,141

[45] Date of Patent: Feb. 22, 2000

[54] SYSTEM FOR EXTERIOR IDENTIFICATION OF BLUEPRINTS AND OTHER CYLINDRICALLY ROLLED DOCUMENTS AND/OR MATERIALS

[76] Inventor: Herman J. Baumann, Jr., 328 E. 4090 South, Salt Lake City, Utah 84107

[21] Appl. No.: 08/933,223

[22] Filed: Sep. 18, 1997

[51] Int. Cl.[7] ..... B24D 15/00

[52] U.S. Cl. ..... 283/79; 283/72

[58] Field of Search ..... 283/70, 72, 74, 283/79, 81, 34, 35, 55, 115; 40/299, 305, 306; D20/28

[56] References Cited

U.S. PATENT DOCUMENTS

| | | | |
|---|---|---|---|
| Re. 29,751 | 9/1978 | Elias et al. | 312/184 |
| D. 353,836 | 12/1994 | Carvelli et al. | D19/27 |
| D. 362,464 | 9/1995 | Butts | D20/28 |
| 1,968,937 | 8/1934 | Gaus | 40/22 |
| 4,679,823 | 7/1987 | Nagy | 281/43 |
| 4,943,177 | 7/1990 | Jordan et al. | 402/72 |
| 5,140,724 | 8/1992 | Crisanti | 24/17 R |
| 5,154,389 | 10/1992 | Hodgin | 248/441.1 |
| 5,197,761 | 3/1993 | Shirdavani | 281/51 X |
| 5,395,137 | 3/1995 | Kim | 283/81 |

*Primary Examiner*—Willmon Fridie, Jr.

[57] ABSTRACT

A system for exterior identification of blueprints or other cylindrically rolled documents is disclosed utilizing an identification indicium having a laterally distended bulb portion affixed to an elongated stem portion. The identification indicium is formed of a unitary piece of flexible yet durable material such as plastic, reinforced paper, cardboard, or the like. Both the bulb portion and stem portion each have a first face opposed parallel to a second face. In contact with the first face of the stem portion is a layer of self stick adhesive of an otherwise conventional type. Along the second face of the bulb portion is a writing surface used to position flat against the outside end of a cylindrical roll of documents. The stem portion extends outward from the bulb portion in one radial direction.

13 Claims, 7 Drawing Sheets

SYSTEM FOR EXTERIOR IDENTIFICATION OF BLUEPRINTS AND OTHER CYLINDRICALLY ROLLED DOCUMENTS AND/OR MATERIALS

RELATED APPLICATIONS

The present invention is a Disclosure Document Number 416,168 filed on Mar. 5, 1997.

BACKGROUND OF THE INVENTION

1. Field of the Invention

The present invention relates generally to document identification devices and, more particularly, to an inexpensive system for the exterior identification of blueprints and other cylindrically rolled documents.

2. Description of the Related Art

As is well known, documents, such as blueprints, are stored in numerous ways. When stored flat with one document on top of another, it is extremely burdensome and time consuming to lift or roll up each large sheet of paper to identify the document below it. Thus, devices were designed to simplify the task of identifying blueprint documents.

The first group of devices was designed to store the blueprints individually in a vertical position. An example of this type of storage means is U.S. Pat. No. 3,850,488, issued in the name of Elias and reissued as U.S. Pat. No. RE 29,751. The '488 device discloses a horizontal supporting bar supported at opposite ends on spaced horizontal rails. Individual documents are attached to and suspended from several hooks which extend from the supporting bar.

There are several problems associated with this type of device. First, it is extremely complicated and expensive, requiring a sizeable investment of capital. Second, the device uses a large amount of space. Third, documents must still be maneuvered to allow space for identification of individual documents.

The second method of blueprint storage is designed to store blueprints in the rolled up position. Often, the documents are stored in large groups in either the vertical or horizontal positions. In order for these documents to be easily and quickly identified without the need for unrolling each document, some sort of external identification system is generally used.

There are several current methods of identifying rolled up documents, such as blueprints. These include writing on outside craft paper covers, paper labels secured with elastic bands, color coded labels with adhesive backings, stringed, metal framed paper tags stapled to the margins of the document, and other similar methods.

These methods, however, have problems associated with their use. Many of these methods leave much to be desired when searching for a particular document in that the document needs to be all or partly removed from surrounding documents in order to see the labels. Illustrative of this is U.S. Pat. No. 5,395,137, issued in the name of Kim. The '137 device discloses a label system that attaches to the exterior of any document. However, when applied to rolled documents stored in a stack, the labels cannot be read without moving other documents out of the way.

In the case of stringed tags, the tag needs to be located and pulled free before it can be read. This can be time consuming and require considerable effort, especially when there are numerous documents with tags to visually inspect Those devices that utilize a fastening device of some sort to attach the means of identification to the document create other problems. For example, stapling tags to the document creates five problems. First, the tags are easily torn free from the staple securing them and subsequently lost, making identification of the document more difficult. Second, when pressure is applied to the staple and it tears free from the document, the document is usually damaged. Third, the staple itself damages the document through penetration when attached. Fourth, the document is likely to be damaged if an attempt is ever made to remove the staple. Fifth, the necessity of having a stapler on hand to attach the tag is an inconvenience. The use of tape adhesives causes problems similar to those discussed above.

To make identification of rolled documents, stored either vertically or horizontally, a quicker and easier process, what is needed in an identification system which lays flat against one end of the rolled documents. This would allow the identification information on rolled documents to be easily read when the documents are stored in both the vertical and horizontal positions.

Placing an identification tag on the end of the rolled documents poses potential problems. A label with an adhesive backing, such as disclosed in the '137 device, cannot be attached directly to the ends of the rolled documents for several reasons. First, there is not enough surface area to effectuate adequate adhesion. Second, the label would not allow the documents to be unrolled. Third, if one attempted to remove the label, the label would almost surely rip the ends of the rolled documents. Fourth, removing the label without ripping the pages would be a slow, arduous task, especially as the adhesive bonded to the paper over time.

A search of the previous art did not disclose any patents that read directly on the claims of the present invention. Consequently, a need has been felt for providing a system for external identification of rolled documents in which the identification tag rests on the end of the rolled documents without being directly attached to the ends of the rolled document pages.

SUMMARY OF THE INVENTION

It is therefore an object of the present invention, to provide an external identification system for rolled documents in which the identification tag rests on the end of the rolled documents without being directly attached to the ends of the rolled document pages.

It is another object of the present invention to provide an improved exterior identification system for rolled documents, such as blueprints, that allows quick blueprint identification without the need to maneuver surrounding documents to see the labels.

It is yet another object of the present invention to provide an improved exterior identification system for rolled documents, such as blueprints, that is simple in design.

Another object of the present invention is to provide an improved exterior identification system for rolled documents, such as blueprints, that is inexpensive. Thus, the present invention can be cost effectively utilized by those who handle many or a few of these types of documents.

Another object of the present invention is to provide an improved exterior identification system for rolled documents, such as blueprints, that is simple to manufacture.

Furthermore, it is another object of the present invention to provide an improved exterior identification system for rolled documents, such as blueprints, that does not damage the rolled documents.

Another final object of the present invention is to provide an improved exterior identification system for rolled documents, such as blueprints, that does not require the user to possess separate adhesives, such as staple or tape.

The present invention in its preferred embodiment consists of a one piece bulb and stem, which is made from a heavy, durable material such as plastic, reinforced paper or cardboard. The stem is coated on one side with a self-stick adhesive. In alternate embodiments of the present invention, the bulb diameter and stem length will vary depending on the cross sectional diameter of the rolled documents to which they are attached.

To use the present invention, the required identification information is written or typed on the side of the bulb opposite the adhesive on the stem. The adhesive backing on the stem is removed, and the stem is attached to the back side of one of the blueprint sheets, so as not to obstruct the reading of information on the blueprint page. As the document is rolled up, the bulb extends beyond the ends of the rolled up pages. Once the document is in the rolled position, the stem is then bent at a right angle to the rolled pages, toward the rolled up ends of the document. Thus, the bulb is positioned on the outside of the roll resting on the rolled up end pages. The document can then be stored either vertically or horizontally with other documents, with the identification information showing on the end of the rolled documents.

In the preferred embodiment of the present invention, the bulb and stem combinations will be produced in a variety of colors so that documents may be identified through color coding. Thus, a color coding system for document identification is incorporated into the present invention. These colors can be used to identify dates, names of contractors or architects, trades, inspector assignments, years, departments, content, and others. Furthermore, the present invention lends itself to personalized color coding through use of colored dots or colored pen markings as deemed useful by the individual.

In alternate embodiments of the present invention, the identification tag is shaped in various configurations, including but not limited to a square, triangle, rectangle, and star. These configurations may be used for document identification purposes, with a particular configuration representing a particular department, trade, etc.

It is further envisioned that the present invention can be used to identify any rolled product, such as carpet, linoleum, fabrics, etc. The size of the bulb and stem would match the cross sectional diameter of the rolled material.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

1. Detailed Description of the Figures

Figure 1:
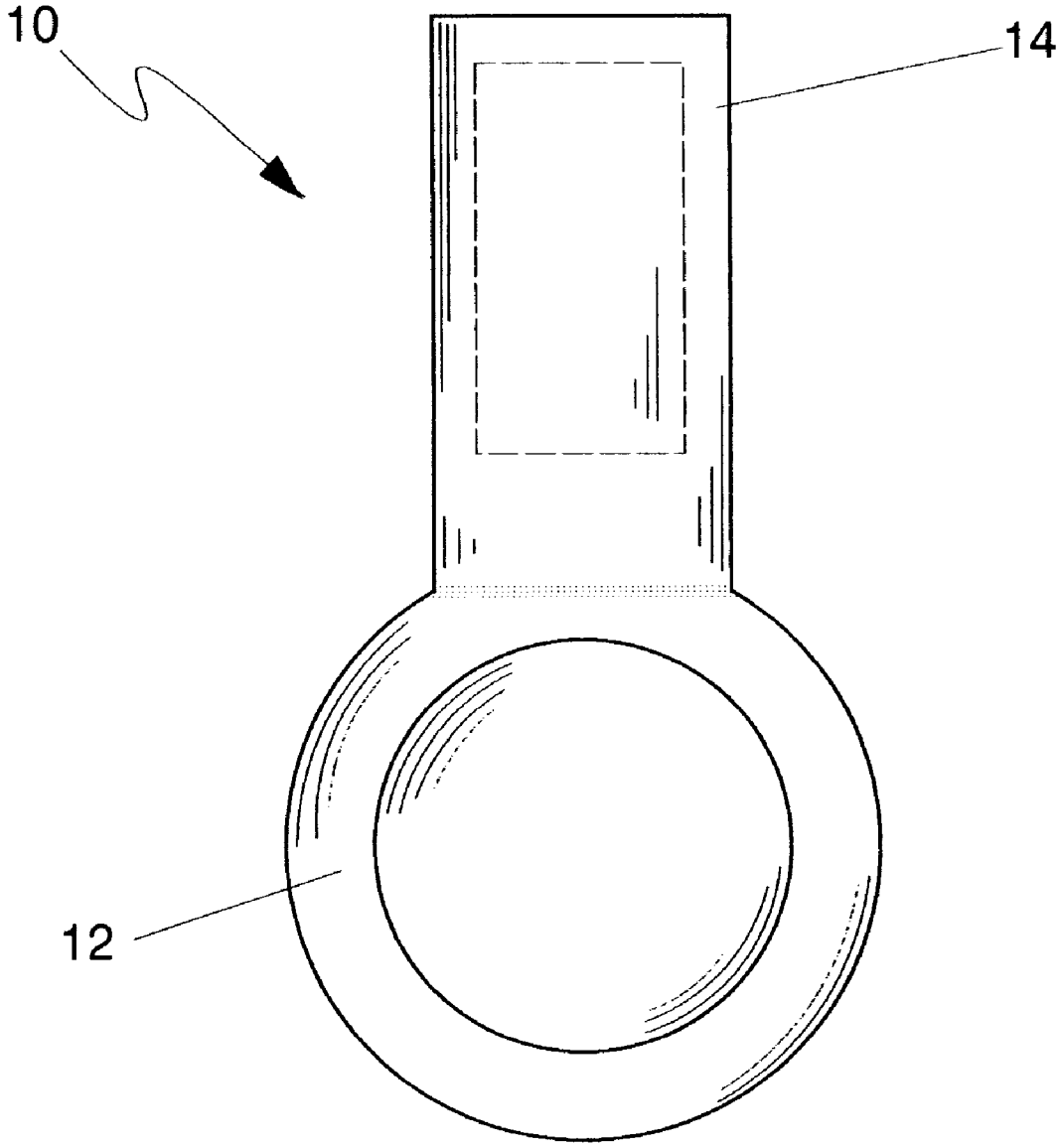
FIG. 1 is a top plan view of an identification indicium for use with a system for exterior identification of blueprints or other cylindrically rolled documents according to the preferred embodiment of the present invention.
Figure 2:
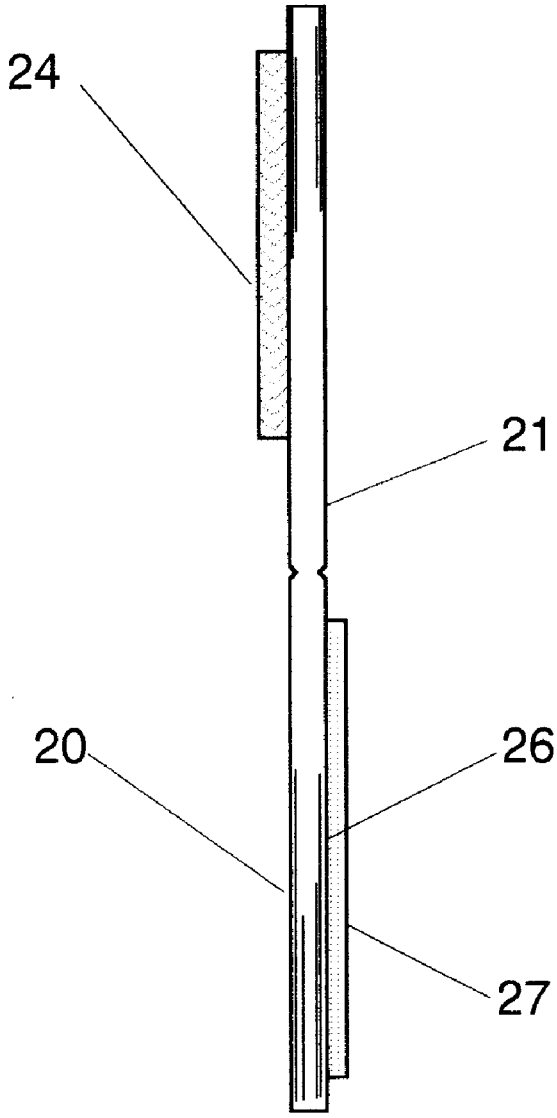
FIG. 2 is a side elevational view thereof.
Figure 3:
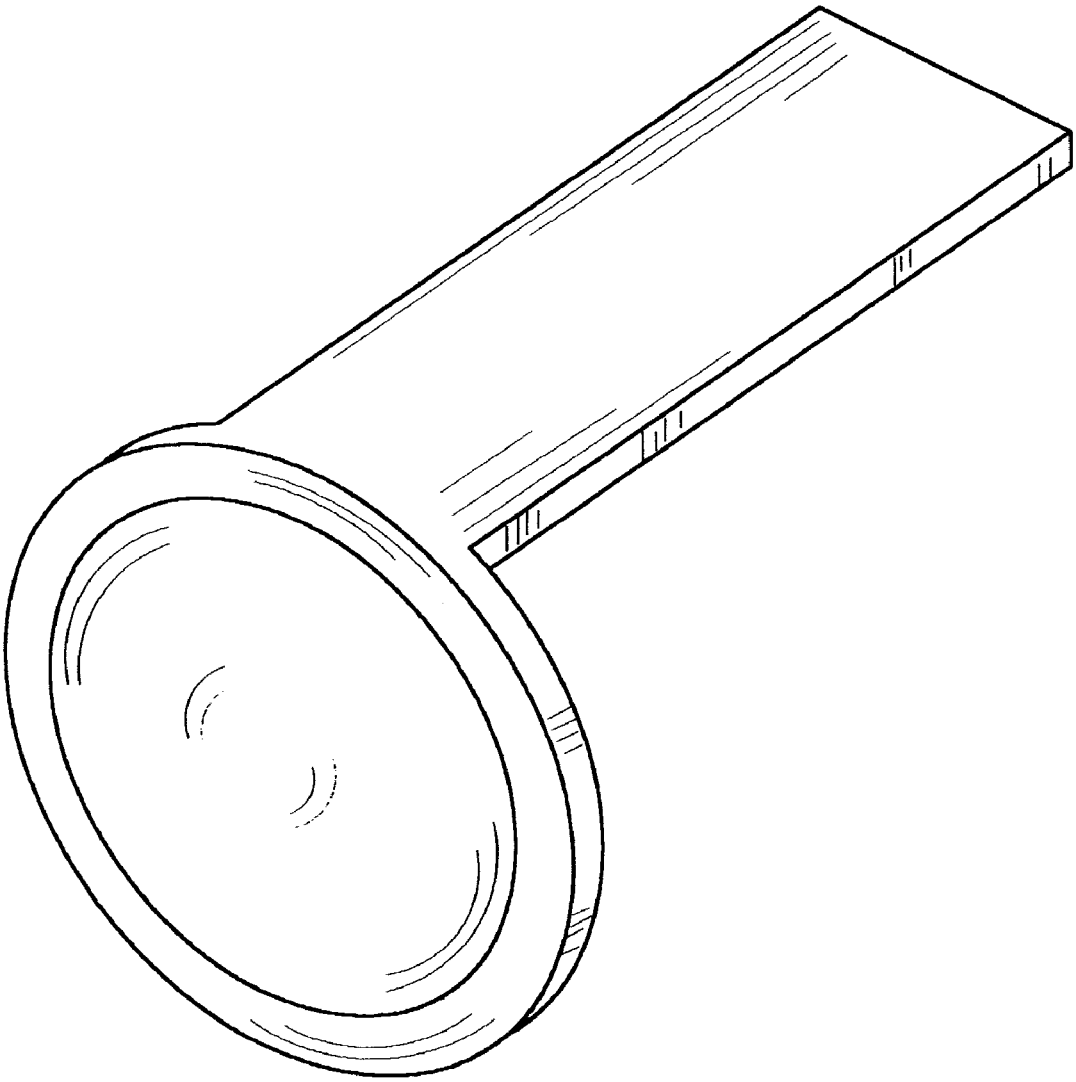
FIG. 3 is a perspective view thereof.

Referring now to FIG. 1, an identification indicium 10 for use with a system for exterior identification of blueprints or other cylindrically rolled documents according to the preferred embodiment of the present invention is shown, having a laterally distended bulb portion 12 affixed to an elongated stem portion 14. It is envisioned in its preferred embodiment that the identification indicia 10 would be formed of a unitary piece of flexible yet durable material such as plastic, reinforced paper, cardboard, or the like. As shown in FIG. 2, both the bulb portion 12 and stem portion 14 are preferably formed as a thin, unitary layer of material having a first face 20 opposed parallel to a second face 21. In contact with the first face 20 of the stem portion 14 is an adhesive means 24. It is envisioned that the adhesive means 24 is a layer of self stick adhesive of an otherwise conventional type. Along the second face 21 of the bulb portion 12 is a writing surface 16. It is envisioned that the entire identification indicia 10 could be formed of a unitary piece of paper or other material capable of being easily adapted as a writable surface; as such, no additional coated would be necessary. However, should plastic, cardboard, or other like material that is not conventionally adaptable to being written upon by a standard pen or pencil writing implements, then a third layer 27, for use as writable coating, can be included.

It is envisioned that both the bulb portion 12 and the stem portion 14 can embody a number of different sizes or shapes for use with a variety of tagging and coding systems. The bulb portion 12 provides the generally enlarged writing surface, and in use will be positioned flat against the outside end of a cylindrical roll of documents. As such, it is envisioned that a circular shaped bulb portion 12 would be effective. Although a square shaped bulb is possible, due to the cylindrical nature of rolled documents it would appear feasible but not practical. However, shapes such as triangular, hexagonal, octagonal and the like, or even circular having segments removed at different locations can be used individually, or together to import various significance when used as part of an overall system of tagging or coding.

The stem portion 14 extends outward from the bulb portion 12 in one radial direction. In order to function effectively, the stem portion 14 has an overall width less than the diameter of the bulb portion. Depending upon the various sizes that can be achieved and envisioned, a stem portion has a lateral width less than or equal to 50% of the bulb diameter. The overall length of the stem portion is sufficient to maintain a frictional or adhesive affixment to or between individual sheets of documents while still maintaining a supporting integrity with the bulb section. In general, again depending upon the various sized that can be achieved and envisioned, a stem portion has a length preferably greater than or equal to the bulb diameter.

Figure 4:
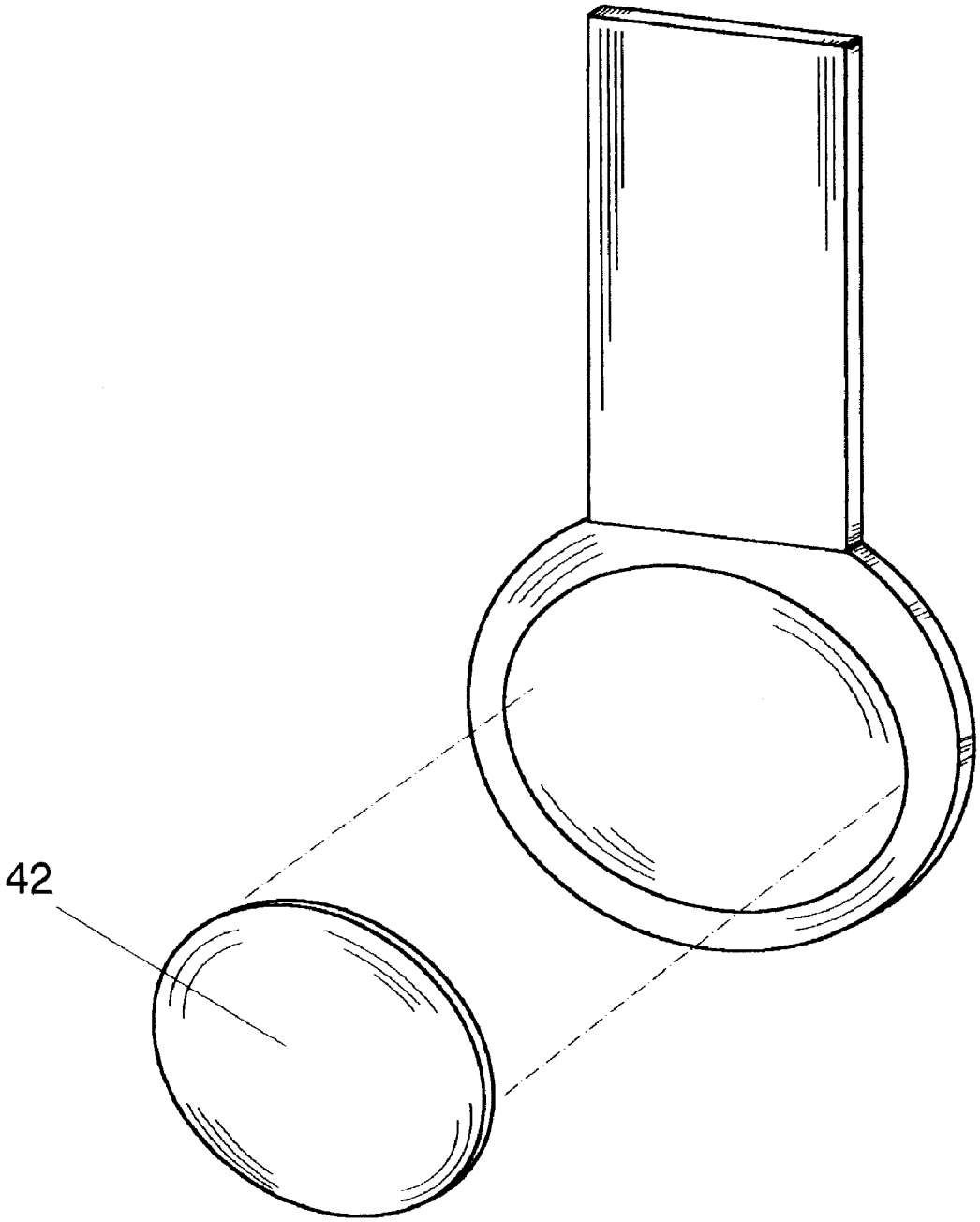
FIG. 4 is a perspective view thereof depicted being applied to a stack of unrolled documents.
Figure 5:
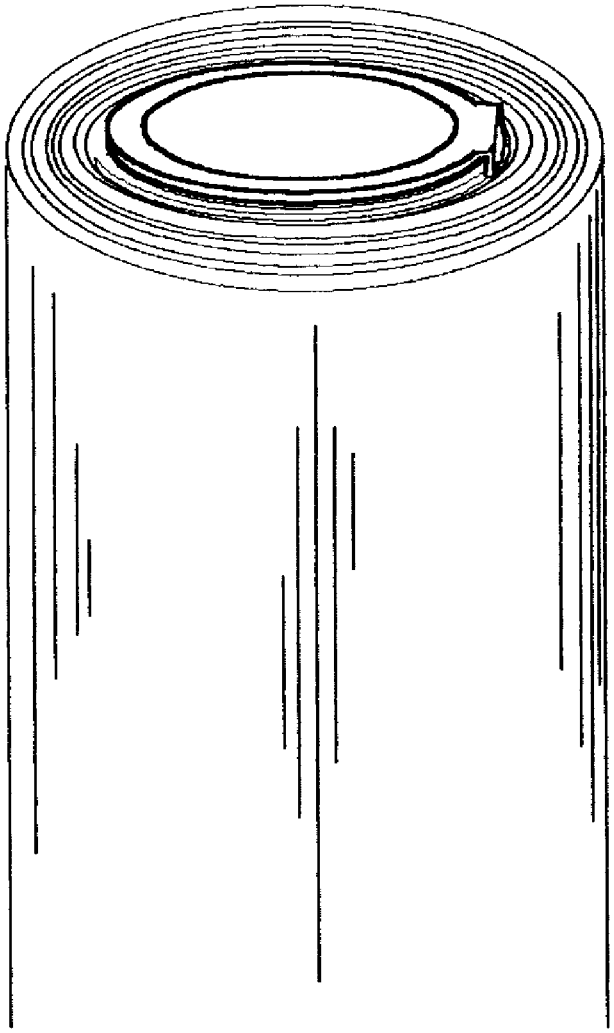
FIG. 5 is a perspective view thereof, depicted in its application with a cylindrical roll of documents.

In FIG. 4 and FIG. 5, an alternate embodiment for the identification indicium 10 for use with a system for exterior identification of blueprints or other cylindrically rolled documents is shown, having a laterally distended bulb portion 12 affixed to an elongated stem portion 14. As shown in FIG. 5, both the bulb portion 12 and stem portion 14 are preferably formed as a thin, unitary layer of material having a first face 20 opposed parallel to a second face 21. In contact with the first face 20 of the stem portion 14 is an adhesive means 24. It is envisioned that the adhesive means 24 is a layer of self stick adhesive of an otherwise conventional type. Along the second face 21 of the bulb portion 12 a writing surface in the form of a primary labeling means 42 is affixed. It is envisioned that in this embodiment the primary labeling means 42 will attach to the second face 21 of the bulb portion 12 in a manner such that the primary labeling means 42 is thereby completely supported. To accomplish this, the primary labeling means 42 must have an overall outer dimension less than that of the bulb portion 12. It is envisioned that the primary labeling means 42 will affix to the bulb portion 14 by means of a conventional adhesive layer. As such, new primary labeling means 42 can be affixed overtop previous layers, thereby allowing a single indicating indicium 10 to be reused at different times to accomplish a different purpose.

2. Operation of the Preferred Embodiment

Figure 6:
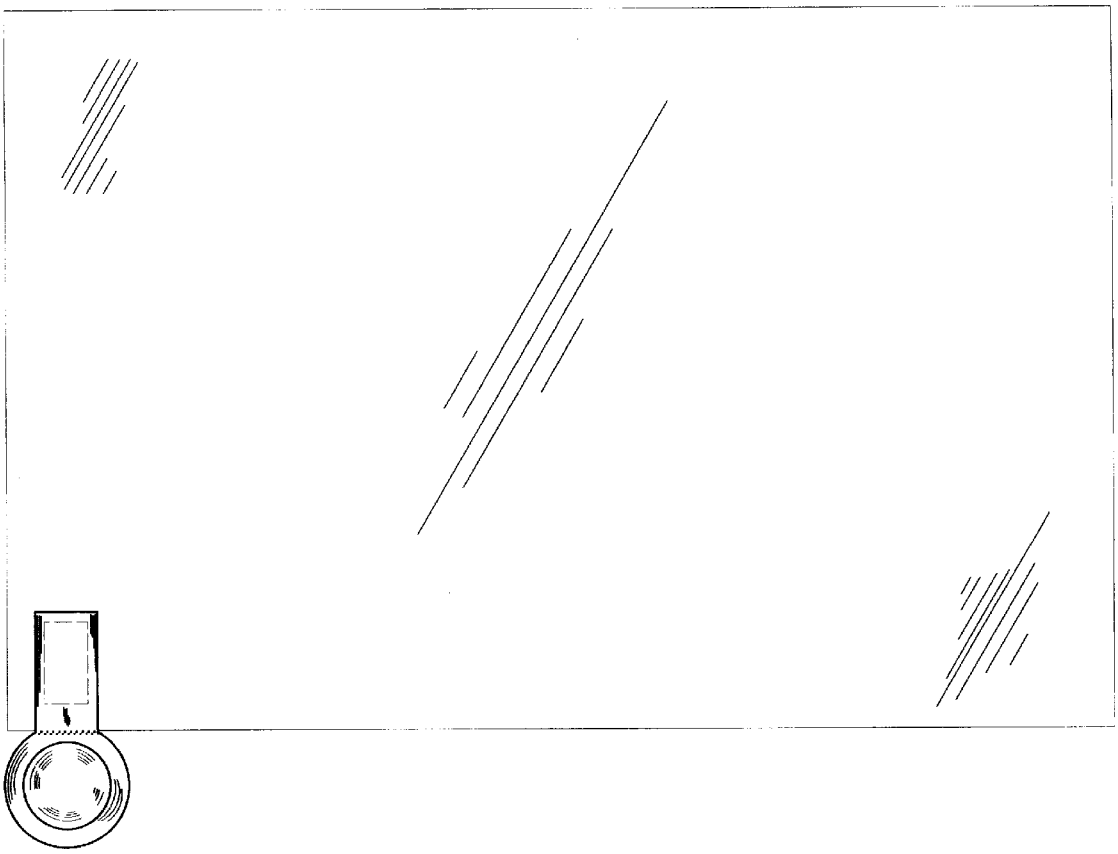
FIG. 6 is an exploded perspective view of an alternate embodiment of the identification indicia as shown and described in FIG. 1.
Figure 7:
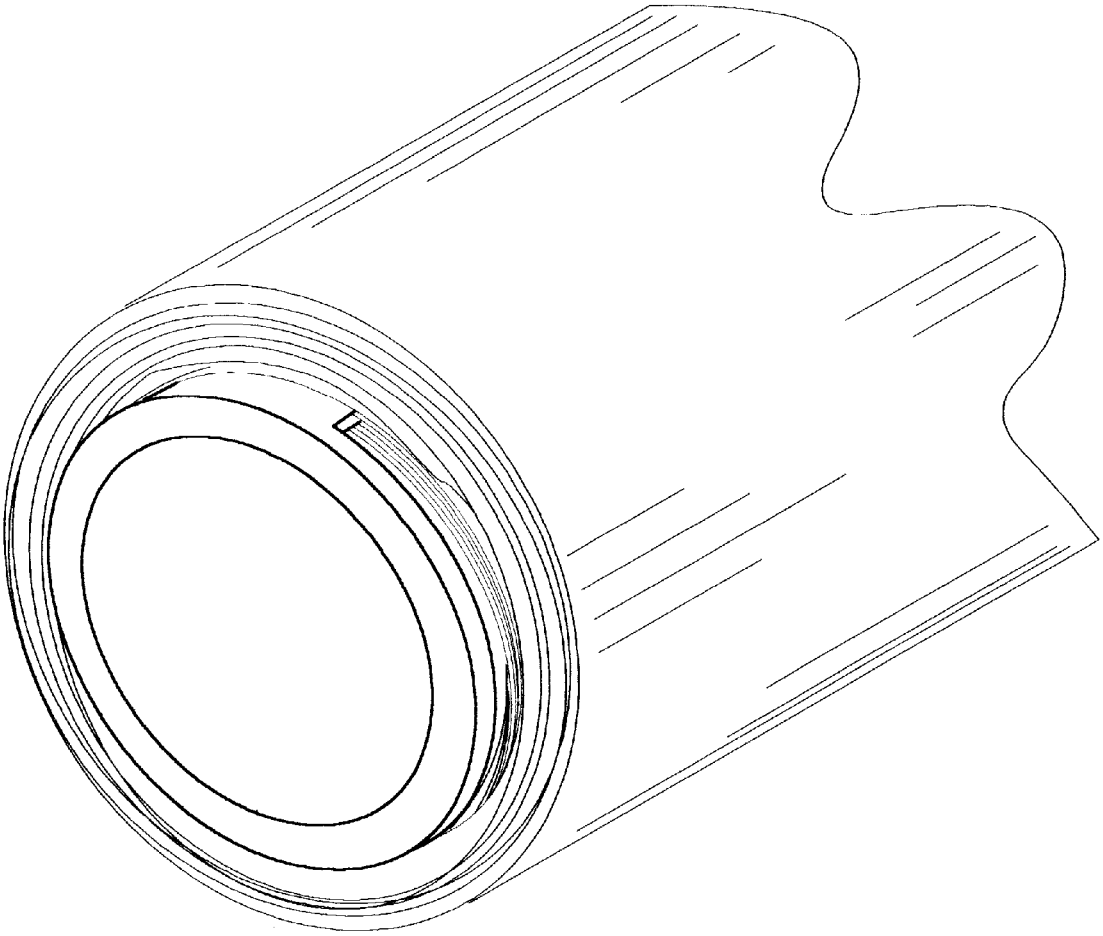
FIG. 7 is an exploded side elevational view of the embodiment of FIG. 6.

To use the present invention, as shown in FIG. 6 and FIG. 7, the required identification information is written or typed on the bulb portion writing face. The adhesive along the stem portion is then affixed to the back side of one of a vertical stack of drawings, so as not to obstruct the reading of information on the page. As the documents are rolled along with others in the stack, the stem is impinged therein and the bulb extends beyond the end of the cylinder. Thus, the bulb is positioned on the outside of the roll resting on the rolled up end pates. The document can then be stored either vertically or horizontally with other documents, with the identification information showing on the end of the rolled documents.

The foregoing description is included to illustrate the operation of the preferred embodiment and is not meant to limit the scope of the invention. It is envisioned that one skilled in the art would develop obvious extensions of the present invention, especially in light of the present disclosure, utilizing the present teaching with a variety of labeling or coding systems. Therefore, it is important that the scope of the invention is limited only by the following claims.

What is claimed is:

1. An identification indicium for use with a system for exterior identification of blueprints or other cylindrically rolled documents or materials, said identification indicium comprising:

an elongated stem portion; and a laterally distended bulb portion affixed to said elongated stem portion such that said stem portion extends outward from the bulb portion in one radial direction;

and wherein said identification indicium is formed of a unitary piece of flexible and durable material.

2. The identification indicium of claim 1, whereas said material includes a member of the group comprising plastic, reinforced paper, and cardboard.

3. The identification indicium of claim 1, wherein both the bulb portion and stem portion are each formed as a thin, unitary layer of material having a first face opposed parallel to a second face, and wherein in contact with the first face of the stem portion is an adhesive means.

4. The identification indicium of claim 3, wherein said adhesive means comprises a layer of self stick adhesive.

5. The identification indicium of claim 3, wherein said second face of the bulb portion comprises a writing surface.

6. The identification indicium of claim 5, further comprising a writable coating applied to and supported by said writing surface.

7. The identification indicium of claim 1, wherein said bulb portion provides a generally enlarged writing surface to be positioned flat against the outside end of a cylindrical roll of documents, said bulb portion having a circular shape.

8. The identification indicium of claim 1, wherein said bulb portion provides a generally enlarged writing surface to be positioned flat against the outside end of a cylindrical roll of documents, said bulb portion forms a variety of geometric shapes.

9. The identification indicium of claim 7 or claim 8, wherein said stem portion has an overall width less than the diameter of the bulb portion.

10. The identification indicium of claim 9, where said stem portion has a lateral width less than or equal to 50% of the bulb diameter, and wherein the overall length of the stem portion is sufficient to maintain a frictional or adhesive affixment to or between individual sheets of documents while still maintaining a supporting integrity with the bulb section.

11. The identification indicium of claim 10, wherein achieved and envisioned, a stem portion has a length preferably greater than or equal to the bulb diameter.

12. The identification indicium of claim 1, further comprising:

a writing surface in the form of a primary labeling means attachable to the second face of the bulb portion in a manner such that the primary labeling means is thereby completely supported.

13. A system for exterior identification of blueprints or other cylindrically rolled documents or materials, said system comprising the utilization of an identification indicium of the type of claim 1 through claim 11, and wherein:

a. required identification information is written or typed on the bulb portion writing face; and b. The adhesive along the stem portion is affixed to the back side of one of a vertical stack of drawings, so as not to obstruct the reading of information on the page;

such that as the documents are rolled along with others in the stack, the stem is impinged therein and the bulb extends beyond the end of the cylinder, thereby positioning the bulb on the outside of the roll resting on the rolled up end pates.

* * * * *